US006858103B2

(12) United States Patent
Wolverton et al.

(10) Patent No.: US 6,858,103 B2
(45) Date of Patent: Feb. 22, 2005

(54) METHOD OF OPTIMIZING HEAT TREATMENT OF ALLOYS BY PREDICTING THERMAL GROWTH

(75) Inventors: Christopher Mark Wolverton, Saline, MI (US); John Edmond Allison, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 236 days.

(21) Appl. No.: 10/151,224

(22) Filed: May 20, 2002

(65) Prior Publication Data

US 2003/0127159 A1 Jul. 10, 2003

Related U.S. Application Data

(60) Provisional application No. 60/347,290, filed on Jan. 10, 2002.

(51) Int. Cl.[7] ..... C22F 1/043; C21D 11/00

(52) U.S. Cl. ..... 148/502; 148/698; 702/130; 702/156

(58) Field of Search ..... 702/130, 156; 148/502, 549–552, 688–704

(56) References Cited

U.S. PATENT DOCUMENTS 4,336,076 A 6/1982 Edamura et al.

6,269,321 B1 7/2001 Palle et al.

OTHER PUBLICATIONS

"Densities of Wrought Aluminum Alloys", by D.E. Kunkle et al, Journal of Materials, pp. 226–240, undated.

"Dimensional Changes in Heat Treating Aluminum Alloys", by H.Y. Hunsicker, Metallurgical Transactions A, vol. 11A, May 1980, pp. 759–773.

*Primary Examiner*—George Wyszomierski
*Assistant Examiner*—Janelle Combs Morillo
(74) *Attorney, Agent, or Firm*—Brooks Kushman P.C.; Damian Porcari

(57) ABSTRACT

The present invention discloses a method for optimizing heat treatment of precipitation-hardened alloys having at least one precipitate phase by decreasing aging time and/or aging temperature using thermal growth predictions based on a quantitative model. The method includes predicting three values: a volume change in the precipitation-hardened alloy due to transformations in at least one precipitation phase, an equilibrium phase fraction of at least one precipitation phase, and a kinetic growth coefficient of at least one precipitation phase. Based on these three values and a thermal growth model, the method predicts thermal growth in a precipitation-hardened alloy. The thermal growth model is particularly suitable for Al—Si—Cu alloys used in aluminum alloy components. The present invention also discloses a method to predict heat treatment aging time and temperature necessary for dimensional stability without the need for inexact and costly trial and error measurements.

13 Claims, 5 Drawing Sheets

METHOD OF OPTIMIZING HEAT TREATMENT OF ALLOYS BY PREDICTING THERMAL GROWTH

CROSS-REFERENCE TO RELATED APPLICATIONS

This application claims the benefit of U.S. provisional application Ser. No. 60/347,290, filed Jan. 10, 2002, entitled "Method Of Optimizing Heat Treatment Of Alloys By Predicting Thermal Growth."

BACKGROUND OF THE INVENTION

1. Field of the Invention

The present invention relates generally to heat treatment of precipitation-hardened alloy components and, more particularly, to a method for predicting thermal growth of precipitation-hardened alloy components during heat treatment.

2. Background Art

Precipitation-hardened alloy components are often heat-treated after casting to impart increased mechanical strength to the alloy. The heat treatment process usually comprises a solution treatment stage, a quenching stage, and an aging stage. During the solution treatment stage, the alloy is heated above its solubility limit to homogenize the alloy. The length of time that the alloy is heated above its solubility limit is often dictated by the amount of inhomogeneity in the alloy before heat treatment. During the quenching stage, the alloy is quenched to a relatively low temperature where the homogeneous state of the alloy solution is frozen in. During the aging stage, the precipitation-hardened alloy is aged below the solubility limit, causing precipitates to nucleate, grow and coarsen with aging time.

The yield strength of the precipitation-hardened alloy initially increases during aging, as precipitates act as obstacles for dislocation motion in the material. However, extended aging usually results in the coarsening of precipitates, which decreases the mechanical strength of the precipitation-hardened alloy. An optimum aging time and temperature exists for the precipitation-hardened alloy to achieve its highest strength before the coarsening of precipitates starts decreasing the precipitation-hardened alloy's strength. This heat treatment, i.e., temper, is usually referred to as T6. Determining T6 values for precipitation-hardened alloys usually requires inexact and costly trial and error adjustments to aging time and temperature.

In precipitation-hardened alloys aged for peak strength, a macroscopic, irreversible, dimensional change has been known to occur during extended in-service, high-temperature exposure. This effect is commonly referred to as thermal growth, since the dimensional change is usually positive.

Thermal growth may detrimentally affect the performance of engine parts constructed of precipitation-hardened alloys, such as engine blocks and engine heads. One such deleterious effect is that engine blocks constructed of aluminum precipitation-hardened alloys may fail emission certification tests. This is because fuel can become trapped if there is a height differential between a cylinder bore on an aluminum alloy engine block and a cast iron cylinder liner. Such a differential can be caused by thermal growth in the aluminum alloy engine block during operation of the engine.

As a result of the deleterious effects of thermal growth, a specialized T7 heat-treatment is often devised to overage the alloy beyond its point of peak strength in order to stabilize the precipitation-hardened alloy against thermal growth. The T7 over-aging is typically accomplished by aging either at higher temperatures or longer times than the T6 temper. For example, T6 treatment of an Al 319 aluminum alloy includes aging the alloy for five hours at 190° C. T7 treatment of Al 319 includes aging the alloy for four hours at 260° C.

The use of lightweight, precipitation-hardened alloy components is anticipated to increase dramatically in the following years. As a result, the automotive and other industries will experience an overall increase in costs associated with heat-treating, precipitation-hardened alloy components. Therefore, the optimization of heat treatment of precipitation-hardened alloy components by decreasing aging times and/or aging temperatures would result in significant cost savings.

It would be desirable to provide a method for optimizing heat treatment of precipitation-hardened alloy components by decreasing aging time and/or temperature using thermal growth predictions based on a quantitative model. It would also be desirable to provide a method that predicts the optimum heat treatment aging time and temperature necessary for dimensional stability without the need for inexact and costly trial and error measurements.

SUMMARY OF THE INVENTION

One aspect of the present invention is to provide a method for optimizing heat treatment of precipitation-hardened alloys. The method includes defining an upper limit of a thermal growth for dimensional stability, predicting a combination of an aging time and an aging temperature which results in the thermal growth being less than or equal to the upper limit of the thermal growth for dimensional stability, and aging the precipitation-hardened alloy for about the predicted aging time and about the predicted aging temperature. The aging for a combination of about the predicted aging time and about the predicted aging temperature produces a dimensionally stable precipitation-hardened alloy. This method can be applied to all precipitation-hardened alloys, and has been found to be particularly effective on Al—Si—Cu alloys.

Another aspect of the present invention is to provide a method for quantitatively predicting thermal growth during heat treatment of precipitation-hardened alloys having at least one precipitate phase. The method includes predicting three values: a volume change in the precipitation-hardened alloy due to transformations in at least one precipitate phase during heat treatment of the precipitation-hardened alloy; an equilibrium phase fraction of the precipitate phases during heat treatment of the precipitation-hardened alloy; and kinetic growth coefficients of the precipitate phases during heat treatment of the precipitation-hardened alloy. Based on these three values and a thermal growth model, the method predicts thermal growth in the precipitation-hardened alloy. This method has been found to be particularly effective on Al—Si—Cu alloys.

Another aspect of the present invention comprises a method that predicts the Cu fraction in precipitation phase θ' for application in yield strength models and precipitation hardening models. The method includes predicting an equilibrium phase fraction of precipitation phase θ', predicts a kinetic growth coefficient of precipitate phase θ', and the fraction of Cu in precipitate phase θ' based on the equilibrium phase fraction of precipitate phase θ' and the kinetic growth coefficient of precipitate phase θ'. The predicted fraction of Cu in precipitate phase θ' is applied to yield strength models and precipitation hardening models.

The above methods use a combination of first-principles calculations, computational thermodynamics, and electron microscopy and diffraction techniques.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENT

The methods of the present invention recognize that precipitate phase transformations to or from the $Al_2Cu$ θ' precipitation phase are the root cause of changes in thermal growth in precipitation-hardened alloy. A model of thermal growth has been constructed from a unique combination of first-principles quantum-mechanical calculations, computational thermodynamics, and electron diffraction and microscopy results. The model accurately provides a quantitative predictor of thermal growth in precipitation-hardened alloys as a function of time and temperature both during aging and in-service exposure without burdensome experimentation and trial and error calculations. The present thermal growth model provides a means to predict the minimum heat treatment time and/or temperature necessary to obtain a dimensionally stable casting.

More particularly, the thermal growth model of the present invention can be applied to quantitatively predict thermal growth in aluminum alloy components. By way of example, the application of the thermal growth model to an Al 319 aluminum alloy heat treatment process is described below. It is to be understood though that the thermal growth model of the current invention can be applied to any precipitation-hardened alloy.

Figure 1A:
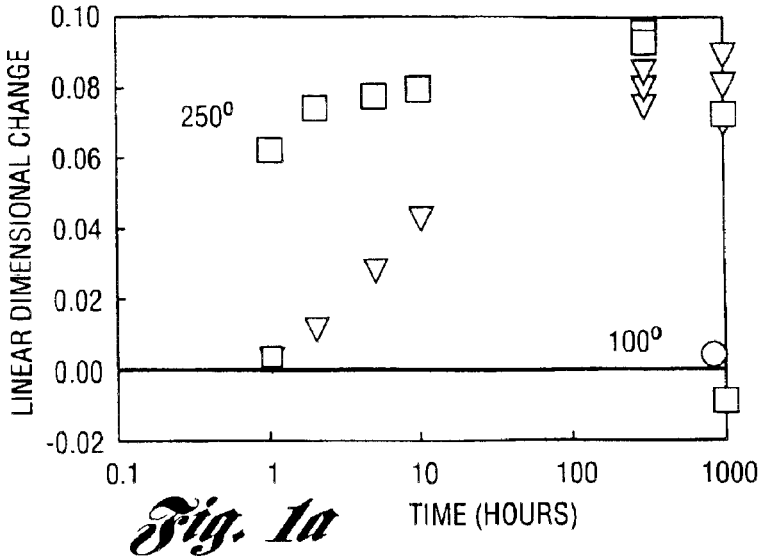
FIG. 1*a* is a graph showing thermal growth versus time for a solution treated Al 319 alloy.
Figure 1B:
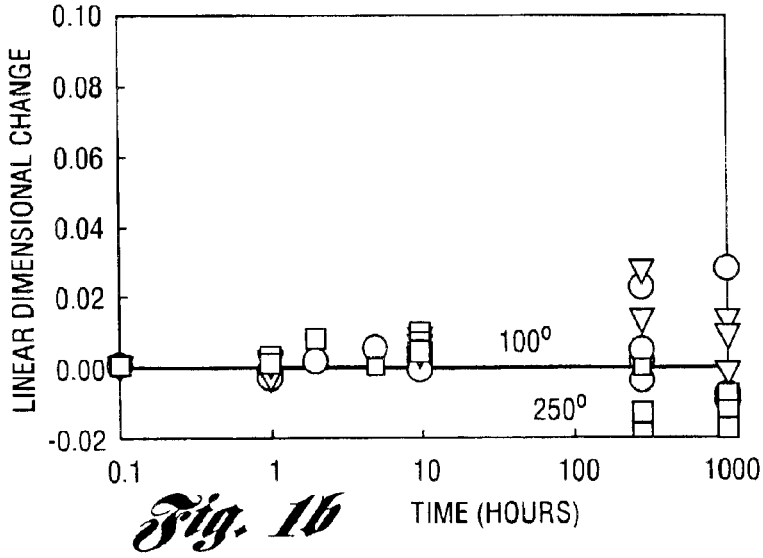
FIG. 1*b* is a graph showing thermal growth versus time for a T7 tempered Al 319 alloy.
Figure 1C:
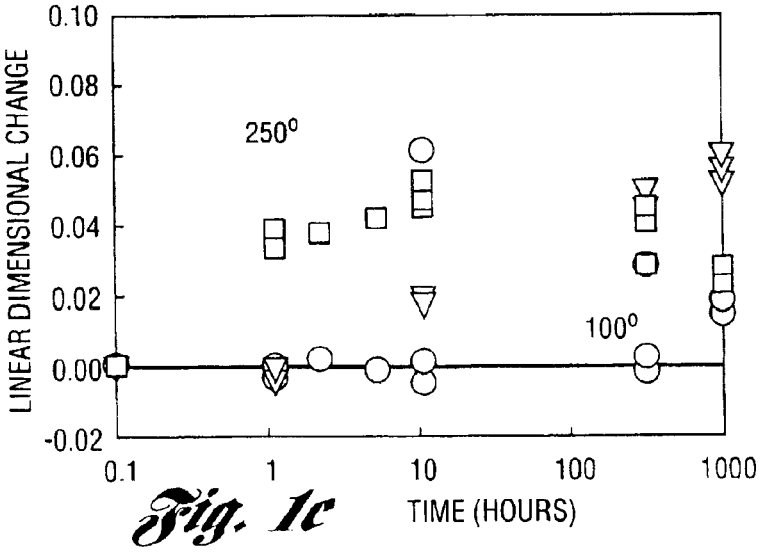
FIG. 1*c* is a graph showing thermal growth versus time for a T6 tempered Al 319 alloy.

FIG. 1*a* depicts thermal growth in Al 319 after thermal sand removal, otherwise referred to as TSR, as a function of exposure time. FIG. 1*b* depicts measured thermal growth in Al 319 after T7 heat treatment as a function of exposure time. FIG. 1*c* depicts thermal growth in Al 319 after T6 heat treatment as a function of exposure time. From FIGS. 1*a*, 1*b*, and 1*c*, the following observations are made: (1) a maximum linear growth of ~0.1% is found for the TSR-only treated materials; (2) in-service exposure at high temperatures gives a faster rise to maximum growth than lower temperature exposure; (3) the T7 temper acts to stabilize the alloy so that there is little in-service growth, and the growth that exists at high temperatures is actually negative, bringing about contraction rather than growth; and (4) after T6 treatment, about half of the maximum growth (~0.05%) is observed compared to TSR-only. These observations indicate that the mechanism of growth is thermally activated.

This thermal growth is attributed to phase transformations that occur during aging due to precipitate phases. Upon aging, a supersaturated Al—Cu solid solution gives way to small coherent precipitates, referred to as Guinier-Preston zones, otherwise referred to GP zones. These GP zones are plate-shaped Cu-rich particles aligned crystallographically along the {001} crystal plane and are often only one atomic layer thick. Upon further aging, a transition phase is formed, the $Al_2Cu$ θ' phase, which is partially coherent with fcc solid solution phase. The $Al_2Cu$ θ' phase forms in a slightly distorted version of the fluorite structure. Continued aging eventually results in the formation of the equilibrium $Al_2Cu$ θ phase. Phase transformations to or from $Al_2Cu$ θ' cause changes in thermal growth. Based on this touchstone, a thermal growth model is constructed.

To construct the thermal growth model of the present invention, a combination of theoretical and experimental methods is used: (1) first-principles quantum-mechanical calculations based on the electronic theory of solids; (2) computational thermodynamics method which are used to compute complex phase equilibriums in multi-component industrial alloys; and (3) electron microscopy and diffraction techniques.

The first-principles calculations are based on density-functional theory. The first-principles calculations are so named because the calculations attempt to solve the fundamental equations of physics at an atomistic level, using atomic numbers of the elements as inputs. As such, properties of real or hypothetical compounds can be ascertained, whether or not the compounds have ever been synthesized in a laboratory. First-principles calculations can generate data that are difficult to obtain experimentally, as is the case for thermodynamic data of metastable phases. One such metastable phase is θ', the primary hardening precipitate phase in precipitation-hardened alloys. Since θ' is not thermodynamically stable, it is difficult to obtain a well-controlled, large quantity of this phase necessary to measure its properties.

However, first-principles calculations yield reliable predictions about metastable states. The following first-principles codes are of particular use in the methods of the present invention: (1) the full-potential linearized augmented plane wave method, otherwise referred to as FLAPW; (2) the Vienna ab-initio Simulation Program otherwise referred to as VASP; and (3) a norm-conserving plane wave pseudopotential code, using linear response methods, otherwise known as NC-PP.

Computational thermodynamics approaches have been successful in predicting phase equilibriums in complex, multi-component, industrial alloys. These methods rely on databases of free energies, obtained from an optimization process involving experimental thermodynamic data combined with observed phase diagrams. With these databases, the computational thermodynamics programs perform minimization of the multi-component free energy functional of interest to predict phase equilibriums. For the methods of the present invention, the computer program PANDAT, developed by CompuTherm LLC of Madison, Wis., with an appropriate thermodynamics database is preferred to compute computational thermodynamics values.

Electron microscopy and diffraction techniques provide a mechanism to obtain the kinetics of precipitate growth in precipitation-hardened alloys.

The method for quantitatively predicting thermal growth during alloy heat treatment is based on the precipitate transformations that occur during heat treatment of precipitation-hardened alloys. In particular, concentration is placed on the transformations of the Cu-containing precipitates as a function of heat-treatment time and temperature. The fundamental idea behind the thermal growth model is: the growth as a function of time and temperature g(t,T) is given by the product of two factors: the volume change δV associated with Cu atoms going from solid solution of volume V to precipitate phases times the phase fraction of precipitate as a function of time and temperature, f(t,T):

$$g(t, T) = \frac{\delta V}{3V} f(t, T) \tag{1}$$

The factor of three in the volume term takes into account the focus on linear change rather than the volumetric change. In algebraic terms, δl/l substantially equals δV/3V for small changes. Since δV is defined below as a volume change per Cu atom, the phase fraction f in Equation 1 and all other equations is actually the atomic fraction of Cu in the phase. For instance, if the alloy contains a total of 1.5 atomic % Cu, then $f \leqq 0.015$.

The phase fraction f is further broken down into two factors: an equilibrium one and a kinetic one. The metastable equilibrium fraction of precipitate phase, $f^{eq}(T)$, e.g., as deduced from the phase diagram and the lever rule, is temperature-dependent but time-independent. The time-dependence of the precipitate fraction growth is given by a Johnson-Mehl-Avrami (JMA) form:

$$f(t,T)=f^{eq}(T)(1-e^{-k(T)t^n}) \tag{2}$$

where k(T) is the kinetic growth coefficient. The exponent n is dependent on precipitate morphology, nucleation rate, and other factors. As applied to the Al 319 alloy, n=1 is appropriate for the case of θ'.

For each precipitate considered, there are three quantities which must be predicted to construct the model: (1) the volume change δV/3V, (2) the temperature-dependent equilibrium precipitate phase fraction, $f^{eq}(T)$, and (3) the temperature-dependent kinetic growth coefficient, k(T). The prediction of each of these three factors is discussed separately.

Figure 2:
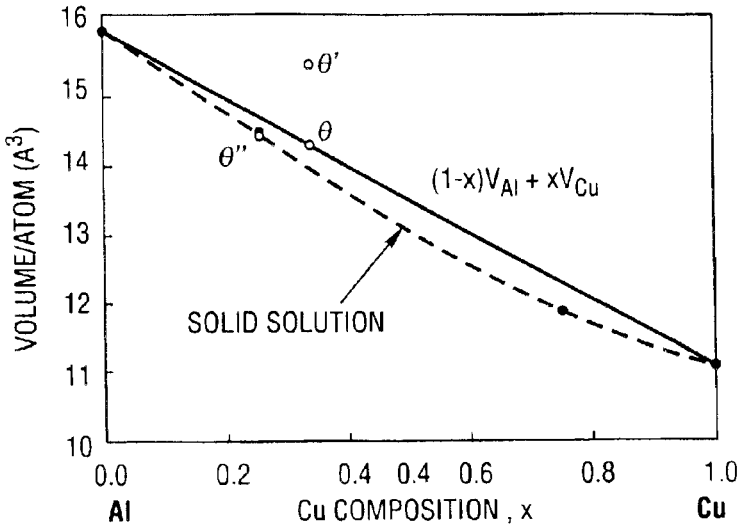
FIG. 2 is a graph showing equilibrium volumes of bulk phases in Al—Cu compounds.

The first factor, δV/3V will be considered in the context of predicting equilibrium volumes. Equilibrium volumes for various Al—Cu phases were obtained from first-principles FLAPW calculations by relaxing all of the lattice-vectors and cell-internal coordinates of each structure to their energy-minimizing positions. Calculations were performed for several structures: pure Al fcc, pure Cu fcc, $Al_2Cu$ θ', $Al_2Cu$ θ'; an $Al_3Cu$ model of GP2 zones, sometimes termed θ"); and the solid solution phase. These first-principles calculated volumes are shown in FIG. 2. Open circles represent the ordered precipitate phases (θ, θ', and θ"). The filled circles are the calculated volumes of solid solution phases with the dashed line representing a polynomial fit to the solid solution volumes. The solid line is simply the linear average of the volumes of pure Al and pure Cu. The θ' phase has a much larger volume than any of the other precipitate phases. This fortifies the idea that phase transformations involving θ' are the primary source of thermal growth.

The quantity desired in Equation 1, δV, is the volume change per Cu atom upon transformation from solid solution to any of the precipitate phases (θ, θ' or θ"). This value is obtained from the volumes of FIG. 2 by considering the volume of formation per Cu:

$$\Delta V_i = \frac{1}{x}\{V_i - [(1-x)V_{Al} + xV_{Cu}]\} \tag{3}$$

The volume of formation is simply the difference in volume between any phase i, and the composition-weighted average of the volumes of pure Al and Cu. x is the atomic fraction of Cu in phase i, and when $V_i$, $V_{Al}$, and $V_{Cu}$ are all given in units of volume per atom, the factor of 1/x is to convert the difference to volume per Cu atom. In terms of a graphical construction, the volume of formation of Equation 3 corresponds to the slopes of the lines connecting each phase in FIG. 2 with pure Al, relative to the straight line connecting pure Al and pure Cu. The solid solution and θ" phase volumes fall below this straight line, and hence will have a slightly negative volume of formation, whereas the opposite is true for θ'.

Figure 3:
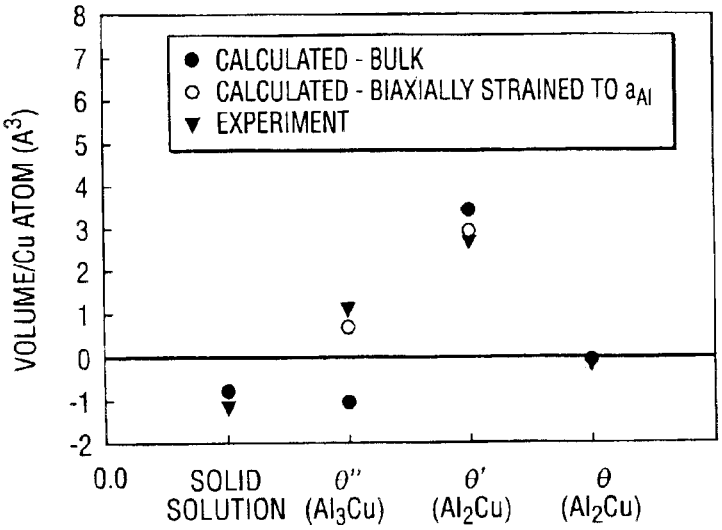
FIG. 3 is a graph showing calculated and experimental volumes of formation for precipitate phases in Al—Cu compounds.

The calculated volumes of formation for the bulk Al—Cu phases are shown in FIG. 3. According to bulk calculations, all lattice vectors are relaxed. However, observed precipitates in Al—Cu are often constrained in one or more directions to be coherent with the Al fcc lattice: Both θ' and GP zones are coherent with the Al matrix along (001) directions. First-principles calculations can be performed accounting for this coherency strain by biaxially constraining the cell vectors of θ' or θ" in the (001) plane to be equal to that of pure Al, and allowing the cell vector perpendicular to (001) to relax. The energy of each phase increases by imposing this constraint, and this change in energy is a measure of the magnitude of the coherency strain energy for each phase.

The calculated volumes of these coherently strained phases are also shown in FIG. 3. The volume of θ" rises significantly with coherency constraint, indicating that the coherent GP zones are under a large tensile strain. On the other hand, the volume of θ' decreases slightly with coherency, indicating that the precipitates of this phase are under a small, but compressive strain.

Measured volumes of formation, accounting for the effects of coherency, are determined from lattice parameter measurements of each of the phases. The first-principles volumes are in agreement with the experimental values. First-principles calculations, especially those based on the local density approximation, typically show an underestimate of lattice parameters of about 1–2% when compared with experiment. This translates to volumetric error of about 3–6%. For example, in pure fcc Al, the experimental volume is 16.6 $Å^3$/atom, whereas the first-principles value is 15.8 $Å^3$/atom, yielding an error of approximately 1 $Å^3$/atom. However, taking into account the differences in volume by considering the volume of formation, the first-principles quantities are often more accurate than the absolute quantities. The errors in the first-principles quantities in FIG. 3 are under 1 $Å^3$/atom.

The linear dimensional change of each phase per Cu atom transformed from solid solution is necessary for the thermal growth model of the present invention. To obtain this quantity, $\delta V/3V$, the differences of quantities in FIG. 3 relative to the value for the solid solution is divided by 3V, where V is the volume of the Al solid solution. The latter quantity was approximated with the experimental volume of pure Al (V=16.60 $Å^3$/atom), yielding a small error of a few percent at most for Al-rich solid solutions. For θ' biaxially strained to the lattice parameter of Al, the calculated value is $\delta V/3V=+0.075$, in excellent agreement with the experimental values of +0.078 and +0.067, deduced from the lattice parameter measurements. This value of $\delta V/3V=0.075$ simply means that for an alloy where 1% Cu has precipitated out of solid solution into θ', the linear dimensional growth will be 0.075%. Similarly, values for θ and θ" (biaxially strained) of $\delta V/3V=0.016$ and 0.030 were obtained, respectively.

Figure 4:
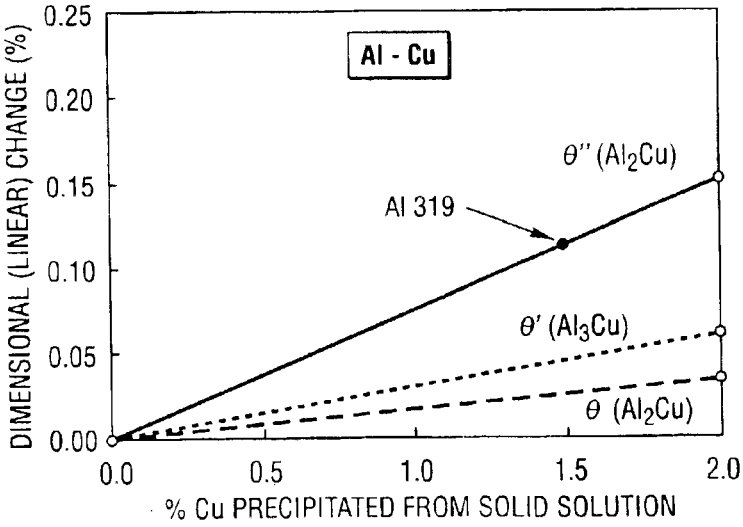
FIG. 4 is a graph showing calculated dimensional change of Al—Cu compounds relative to solid solution.

Using these values, a graph is constructed of dimensional change versus percentage of Cu precipitated, which is depicted in FIG. 4. According to FIG. 4, the total amount of Cu in a typical 319 alloy is indicated as ~1.5 atomic %, yielding an upper bound to the total growth of approximately 0.12%. This quantity is an upper bound to the actual growth because it indicates the hypothetical growth that would occur upon all of the Cu in the alloy precipitating out as θ'. Still, this estimate is in reasonably quantitative accord with the maximum measured growth in FIGS. 1*a*, 1*b* and 1*c*.

The disclosed construction of $\delta V/3V$ accounts for both the change in volume due to the precipitate volume, and also the change due to the solute content of the solid solution. The two factors are interrelated: as each Cu atom moves from solid solution to precipitate phase, there is one more atom of precipitate phase, and one less solute atom in solid solution.

The second factor in the thermal growth model is $f^{eq}(T)$, the temperature-dependent equilibrium phase fraction of precipitate phases. The complexities of multi-component precipitation-hardened alloys are taken into account using computational thermodynamics methods. Using these methods, as implemented in the PANDAT code, the phase fraction of stable phases is obtained. However, calculating the phase fraction of the metastable θ' phase is necessary. In order to arrive at such values, free energy data for θ and θ' calculated from first-principles methods are incorporated into computational thermodynamics codes.

Figure 5:
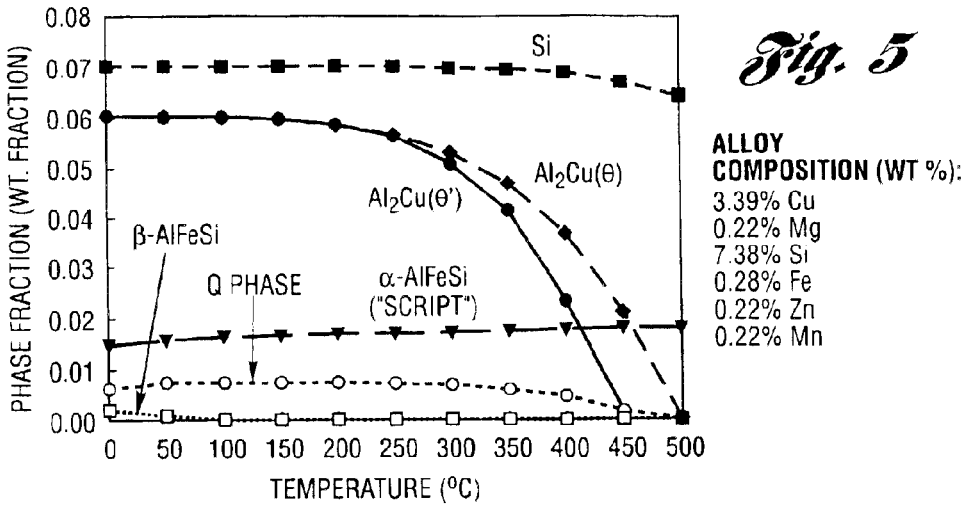
FIG. 5 is a graph showing calculated equilibrium phase fractions in Al 319 alloy as a function of temperature.

The resulting calculations of phase fractions for a seven-component system with compositions that mimic an Al 319 alloy are shown in FIG. 5. Results are shown both for stable phases and metastable phases. The fractions of the stable phases are calculated first. Five stable phases are indicated by the calculation, all of which are observed in Al 319 alloy castings: diamond Si, $Al_2Cu$ (θ), the Al—Cu—Mg—Si quaternary or Q phase, and two Fe-containing phases, α-AlFeSi or script, and β-AlFeSi. These phase fractions are shown in FIG. 5. However, with the addition of the θ' free energy to the code, the metastable phase fractions can be calculated by suppressing the θ phase from the calculation. The resulting fraction of θ' is also shown in FIG. 5. Parameterized calculations for the curves of FIG. 5 are given below for use in the thermal growth model.

The third factor in the thermal growth model is the temperature-dependent kinetic growth coefficient, k(T). As applied to the Al 319 aluminum alloy, k(T) for both θ and θ' phases is obtained from the experimental TTT diagram of Al 319. The boundaries are indicative of when a given precipitate type is first observed. Therefore, the boundaries given are parameterized. The current parameterization of the kinetic growth coefficients, k(T), are given below.

The thermal growth model of the current invention factors in the effect of the solidification rate on thermal growth. There is indirect dependence of thermal growth on solidification rate. During solidification, the liquid alloy undergoes several thermal arrests as it proceeds through a variety of eutectic transformations. One such eutectic is the $Al_2Cu$ (θ) phase. In contrast to the $Al_2Cu$ precipitate phases (GP, θ', and θ) which are small, sub-micron sized particles and occur in the primary Al portion of the microstructure, the $Al_2Cu$ eutectic phase is usually the θ structure, and forms coarse, micron-sized particles separate from the primary Al phase. The solution treatment portion of the heat treatment is, in part, designed to dissolve these coarse, non-equilibrium particles of eutectic $Al_2Cu$, and reincorporate them into the primary Al. The solidification rate determines the amount of eutectic $Al_2Cu$ formed initially, and the solution treatment time/temperature determines how much of these eutectic phases are dissolved.

These factors effect thermal growth only in so much as they determine how much of the Cu is available for precipitation and how much is lost to eutectic $Al_2Cu$. For instance, a long solution treatment stage will effectively dissolve all of the eutectic $Al_2Cu$, making more Cu available for precipitation and ultimately thermal growth.

For the growth model of the present invention as applied to the Al 319 alloy, it is assumed that 10% of the total Cu is lost to eutectic phases. This is a reasonable number for a typical solidification rate for a thick section and whose eutectic $Al_2Cu$ has not been dissolved by heat treatment. The loss of Cu due to eutectic $Al_2Cu$ is incorporated in the model by multiplying the calculated thermal growth by a constant factor of 0.9.

Figure 6:
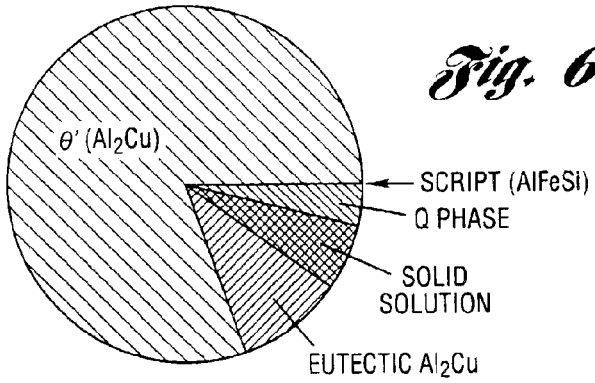
FIG. 6 is a pie chart showing calculated distribution of Cu in Al 319 alloy at 250° C.

To illustrate all of the various places where Cu can wind up in the microstructure, a simple pie chart of the distribution of Cu in Al 319 is shown in FIG. 6. FIG. 6 shows the distribution of Cu at 250° C. While most of the Cu is contained in θ' precipitates, a large fraction is also present in other forms: Q phase precipitates, solid solution (Cu still has some solubility in Al at 250° C.), a small amount is soluble in the AlFeSi script phase, and a portion is lost to eutectic $Al_2Cu$.

The thermal growth model of the present invention also accounts for non-isothermal exposure. Thermal growth occurs both during aging and also during in-service exposure. The aging and in-service temperatures need not necessarily be equal, so it is desirable to have the thermal growth model capable of non-isothermal aging. Although a completely general non-isothermal model could be incorporated, it complicates the thermal growth model to some extent, and so instead a two-step exposure is incorporated, where each of the two steps can be at arbitrary temperature, but each step is isothermal. Therefore, as input to the model, an aging time and temperature ($t_a$, $T_a$) and an in-service temperature $T_s$ is specified. The profile of temperature is discontinuous between these two steps, but the evolution of volume fraction of precipitate must be continuous. By shifting the time during in-service exposure, continuity of phase fraction is guaranteed. Formulas for the time shift are given below.

The equations used in constructing the thermal growth model of the current invention are given below. First, the equations which are generally applicable to thermal growth, in any precipitation-hardened alloy, not merely Al 319 are presented. Then, the parameterized functions specific to Al 319 are presented.

The general expression for thermal growth g(t,T) as a function of time and temperature is:

$$g(t, T) = (1-\gamma)\sum_{i=1}^{n} \frac{\delta V_i}{3V_i} f_i(t, T) \tag{4}$$

As an example of this general form, the expression for growth in a precipitation-hardened alloy containing θ and θ' is:

$$g(t, T) = (1-\gamma)\left[\frac{\delta V_{\theta'}}{3V} f_{\theta'}(t, T) + \frac{\delta V_{\theta}}{3V} f_0(t, T)\right] \tag{5}$$

The contribution due to both θ' and θ has been summed. The θ phase is included here because it is the transformation both to and from θ' which cause changes in thermal growth. The θ' phase upon extended exposure to elevated temperature will transform to θ. The factor γ accounts for the fraction of Cu which is lost to eutectic $Al_2Cu$ (θ') phase. $f_i(t,T)$ is the fraction of Cu involved in each precipitate phase i as a function of time and temperature. For the θ' phase, it is broken up as follows:

$$f_\theta(t,T)=f_\theta^{eq}(T)(1-\exp[-k_\theta(T)(t+\Delta_\theta)]) \tag{6}$$

$f_i^{eq}(T)$ is the temperature-dependent equilibrium fraction of phase i as predicted from the stable or metastable phase diagram. For the θ' phase, the phase fraction is given by a slightly different expression:

$$f_{\theta'}(t,T)=f_{\theta'}^{eq}(T)(1-\exp[-k_{\theta'}(T)(t+\Delta_{\theta'})])-f_\theta(t,T) \tag{7}$$

with the constraint $$f_{\theta'}(t,T)\geqq 0 \tag{8}$$

The fraction of θ is subtracted from that of θ' because it is assumed that the growth of θ is accompanied by the simultaneous reduction of θ', either via dissolution or direct transformation. In both Equations 6 and 7, $k_i(T)$ are the kinetic growth coefficients for phases i, and $\Delta_i$ are the time shifts applied to guarantee continuity of the phase fractions at the change, at time $t_a$, from aging temperature $T_a$ to in-service temperature $T_s$.

$$\Delta_i = \frac{-1}{k_i(T_s)} \ln\left[1 - \frac{f_i(t_a, T_a)}{f_i^{eq}(T_s)}\right] - t_a;\ t \geq t_a \tag{9}$$

$$\Delta_i=0;\ t<t_a \tag{10}$$

The above expressions are generally applicable for the thermal growth encountered in any precipitation hardened alloy, changing the phases i from θ and θ' to the ones of interest.

For the growth model of the current invention as applied to Al 319, several functions particular to the Al 319 are parameterized. The eutectic phase fraction parameter is chosen to be γ=0.1, indicating a loss of 10% Cu to eutectic phases, consistent with a typical solidification rate in a thick section.

The kinetic growth coefficients are parameterized from the TTT diagrams as:

$$k_\theta(T) = 0.43\ \exp\left[\frac{161}{473-T} - 3.33\right] \tag{11}$$

$$k_{\theta'}(T) = 0.43\ \exp\left[\frac{-11800}{T} + 24.34\right] \tag{12}$$

with T in degrees Kelvin and k in units of hours$^{-1}$.

The equilibrium phase fractions, or the atomic % Cu in these phases, are parameterized from the combination of first-principles/computational thermodynamics calculations of FIG. 5:

$$f_\theta^{eq}(T) = 0.01417 - \exp\left[-11.6045 * \frac{370.9 - 0.097T}{T}\right] \tag{13}$$

$$f_{\theta'}^{eq}(T) = 0.01420 - \exp\left[-11.6045 * \frac{396.2 - 0.165T}{T}\right] \tag{14}$$

with T in degrees Kelvin. These parameterizations fit the available data well in the range T=0–300° C. Equations 4–14 make up the thermal growth model as a function of aging time, aging temperature, and in-service temperature.

Figure 7A:
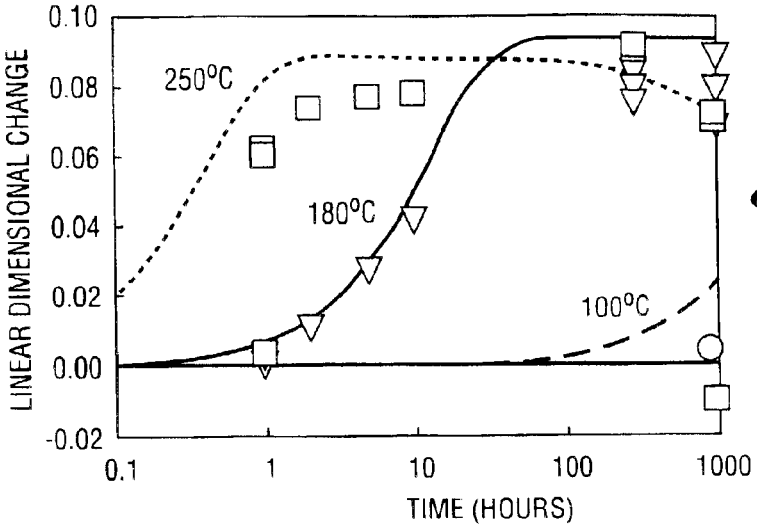
FIG. 7*a* is a graph showing thermal growth versus time for a solution treated Al 319 alloy computed using the thermal growth model.
Figure 7B:
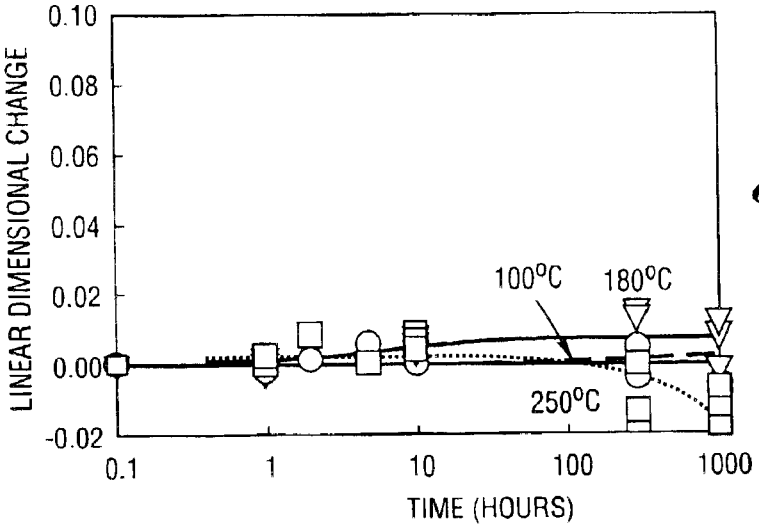
FIG. 7*b* is a graph showing thermal growth versus time for a T7 tempered Al 319 alloy computed using the thermal growth model.
Figure 7C:
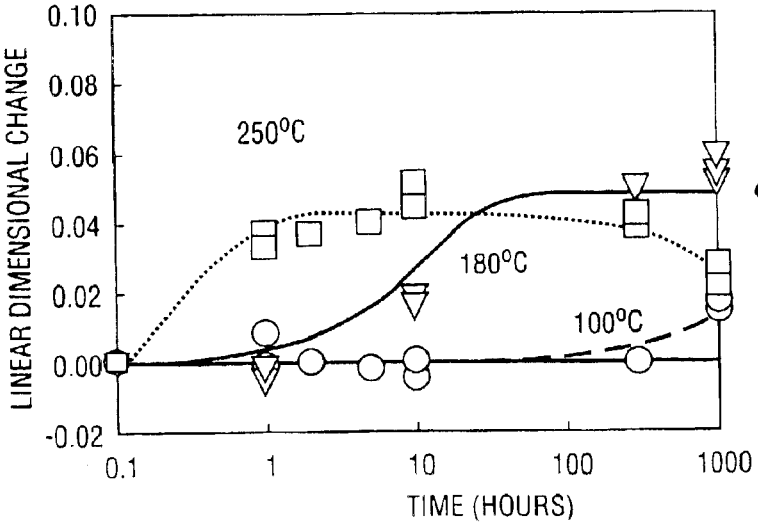
FIG. 7*c* is a graph showing thermal growth versus time for a T6 tempered Al 319 alloy computed using the thermal growth model.

In FIGS. 7*a*, 7*b*, and 7*c*, the same measured thermal growth data as in FIGS. 1*a*, 1*b*, and 1*c*, respectively, is given including the analogous results calculated from the thermal growth model. FIG. 7*a* is a graph showing linear growth versus time for a solution treated Al 319 alloy computed using the thermal growth model. FIG. 7*b* is a graph showing linear growth versus time for a T7 tempered Al 319 alloy computed using the thermal growth model. FIG. 7*c* is a graph showing linear growth versus time for a T6 tempered Al 319 alloy computed using the thermal growth model. For in-service exposure following TSR, T7, or T6 heat treatment, the model provides a quantitative predictor of the amount of growth observed in Al 319. In particular, the stability of the alloy after T7 (but not T6) heat treatment is reproduced by the model. The agreement between the thermal growth model and measured data confirms the notion that transformations to or from precipitate phases are the root cause of changes in thermal growth in precipitation-hardened alloys and in particular, transformations involving $Al_2Cu$ θ' are responsible for thermal growth in Al 319.

Figure 8A:
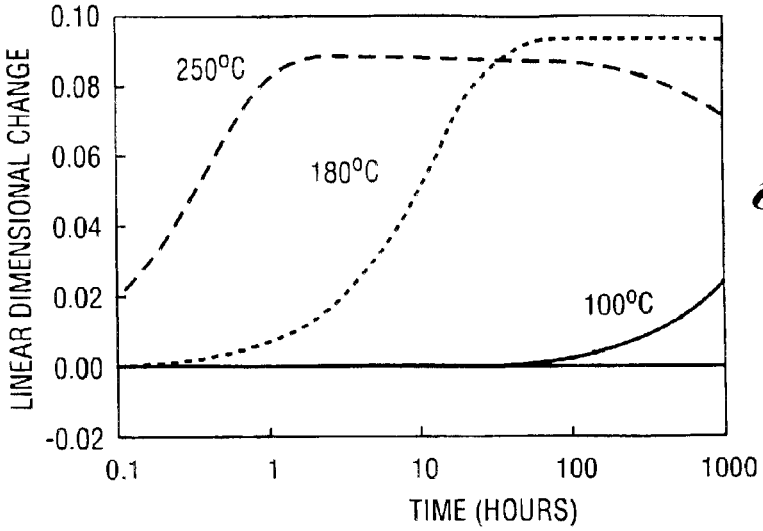
FIG. 8*a* is a graph showing total thermal growth during aging and in-service exposure for an Al 319 alloy as a function of exposure time and temperature for solution treatment.
Figure 8B:
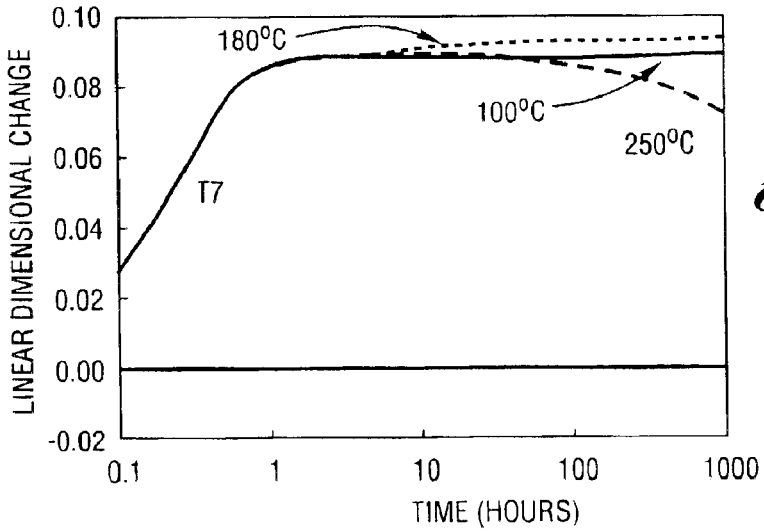
FIG. 8*b* is a graph showing total thermal growth during aging and in-service exposure for an Al 319 alloy as a function of exposure time and temperature for T7 treatment.
Figure 8C:
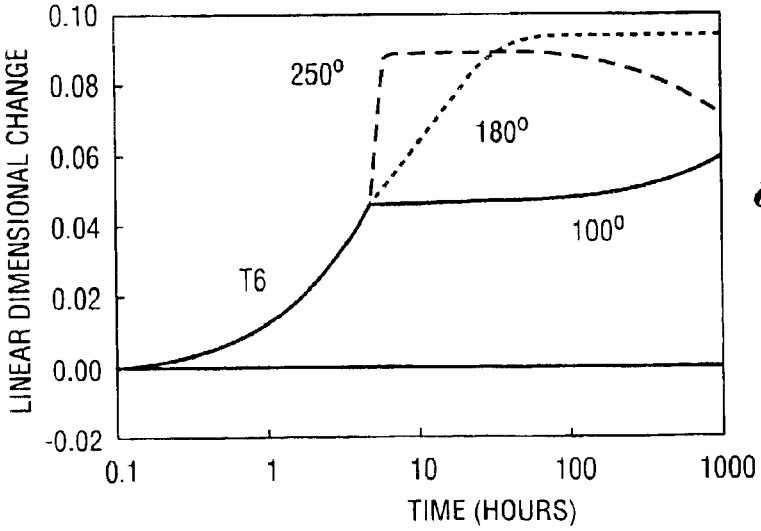
FIG. 8*c* is a graph showing total thermal growth during aging and in-service exposure for an Al 319 alloy as a function of exposure time and temperature for T6 treatment.

From the model, not only can the growth due to in-service exposure be examined, but also the total growth that occurs both during aging and in-service operation. The results of total growth are given in FIGS. 8*a*, 8*b*, and 8*c* for the same three aging schedules as in FIGS. 7*a*, 7*b*, and 7*c*. FIG. 8*a* shows total thermal growth during aging and in-service exposure for solution treatment. FIG. 8*b* shows total thermal growth during aging and in-service exposure for T7 treatment. FIG. 8*c* shows total thermal growth during aging and in-service exposure for T6 treatment.

FIGS. 8*a*, 8*b*, and 8*c* depict total thermal growth, a linear dimensional change, during aging and in-service exposure in Al 319 as a function of exposure time and temperature. From these figures, the reasons for why growth occurs after T6 treatment are examined. The T6 heat treatment results in incomplete growth of the θ' phase, and therefore thermal exposure after T6 results in growth of more precipitate phase, and hence a dimensional instability. On the other hand, the T7 heat treatment is at higher temperature, where the enhanced kinetics yields complete growth of the θ' phase.

According to the present invention, three sources of thermal growth may occur during in-service operation: (1) incomplete growth of the θ' phase during heat treatment; (2) an alloy which is aged at high temperature but in-service at lower temperature may exhibit thermal growth due to the solubility difference of Cu between these two temperatures; and (3) long-term and/or high-temperature thermal exposure causes growth of the equilibrium θ phase, depletes the amount of θ', and can cause a decrease in thermal growth.

These three sources can explain all of the observed growth in FIGS. 7*a*, 7*b*, and 7*c*. During TSR-only treatment, the growth during in-service exposure is due almost entirely to (1), however, for extended exposure at high temperatures, factor (3) comes into play. During T7 treatment, the growth of θ' is nearly complete, and therefore the alloy is almost completely stabilized. However, a small amount of growth is observed during exposure at 190° C., due to factor (2), and a small amount of θ forms at 250° C., leading to a small decrease in growth due to factor (3). Even these subtleties at the limit of experimental detection are reproduced by the model. During T6 treatment, the aging process results in incomplete growth of θ', and subsequent exposure results in further growth due to factor (1). The T6 growth curve of FIG. 7*c* also shows the subtle characteristic of the TSR-only curve due to factor (3) at high-temperature exposure.

Figure 9:
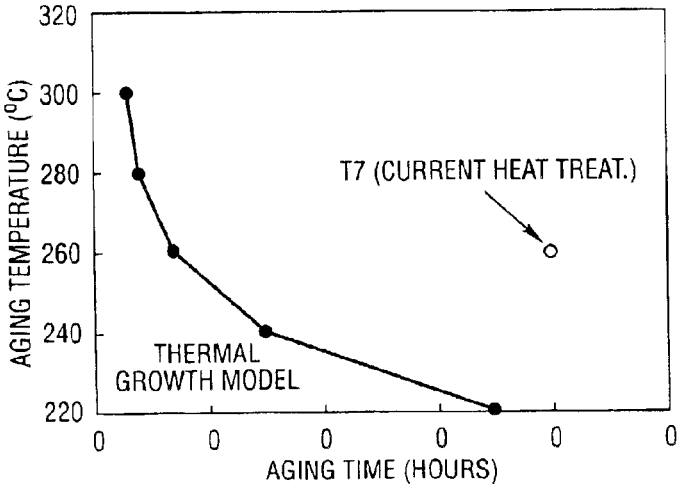
FIG. 9 is a graph showing predicted minimum aging time to produce a dimensionally stable Al 319 alloy.

In another preferred embodiment, the growth model may also be inverted. In its inverted form, the graph model can predict the minimum heat-treatment time/temperature needed to provide a specific level of thermal stability. FIG. 9 shows the results of such inverse modeling with the prediction of minimum heat treatment time necessary to obtain a stable alloy. Stability in this case defined as 0.015% or less growth (either positive or negative) during in-service exposure between room temperature and 250° C. for up to 1000 hours. The detection limit of thermal growth measurements is approximately 0.01%. However, a slightly higher value of 0.015% is preferred as the stability limit in FIG. 9. The growth model predicts that the T7 heat treatment shows an in-service negative growth of ~0.015% of the current invention for long exposure times at high temperatures (see FIG. 7). Thus, the definition of stability in FIG. 9 was chosen to be 0.015% rather than 0.01% so that the current T7 treatment would be considered stable.

This sort of prediction can be very useful in optimizing heat-treatment processing schedules. Three examples of the type of information that can be predicted from FIG. 9 illustrate this point. Aging for 0.7 hours at T=260° C. (time at temperature) is sufficient to achieve a stable casting, whereas a typical heat-treatment schedule currently used in production involves a T7 aging for 4 hours at T=260° C. (which includes the time to reach temperature). Depending on the time necessary to reach the aging temperature, this result suggests that there might be a substantial opportunity for optimizing the minimum aging time during the T7 heat treatment. An increase of the aging temperature by 20° C. (to T=280° C.) could be accompanied by a 0.3 hour reduction in aging time while still maintaining dimensional stability. Conversely, a decrease of aging temperature to 240° C. would necessitate lengthening the aging time from 0.7 hours to 1.5 hours. Above 300° C., there is no heat treatment time that will give a dimensionally stable alloy. This fact is due to the solubility difference between an aging temperature of T>300° C. and an in-service temperature of 0–250° C. being large enough to cause growth in excess of 0.015%.

The effects of thermal growth can also be incorporated into yield strength models. The construction of the thermal growth model has produced an accurate model of the phase fraction of θ' as a function of time and temperature. This type of information is necessary in models of yield strength and precipitation hardening.

While the best mode for carrying out the invention has been described in detail, those familiar with the art to which this invention relates will recognize various alternative designs and embodiments for practicing the invention as defined by the following claims.

What is claimed:

1. A method for optimizing alloy heat treatment by quantitatively predicting thermal growth during alloy heat treatment, the method comprising the steps of:

(a) predicting a volume change due to transformations in an each precipitate phase;

(b) predicting an equilibrium phase fraction of the each precitate phase;

(c) predicting a kinetic growth coefficient of the each precipitate phase;

(d) predicting thermal growth in a precipitation-hardened Al —Si—Cu alloy according to a thermal growth model using the volume change due to transformations in the each precipitate phase; the equilibrium phase fraction of the each precipitate phase; and the kinetic growth coefficient of the each precipitate phase, wherein the thermal growth model may be expressed mathematically as:

$$g(t, T) = (1-\gamma)\sum_{i=1}^{n} \frac{\delta V_i}{3V_i} f_i(t, T)$$

where $$\frac{\delta V_i}{3V_i}$$

is volume change due to transformations in precipitate phase i, $f_i(t,T)$ is fraction of solute in precipitate phase i as a function of time and temperature, T is temperature, t is time, and γ is fraction of solute lost to eutectic phases; and (e) aging the precipitation-hardened Al—Si—Cu alloy for an aging time (t) and an aging temperature (T) according to the thermal growth model to produce a dimensionally stable precipitation-hardened Al—Si—Cu alloy.

2. The method of claim 1, wherein the volume change due to transformations in precipitate phase i may be expressed mathematically as:

$$\Delta V_i = \frac{1}{x_i}\{V_i - [(1-x_i)V_{Al} + xV_{Cu}]\}$$

where $V_1$ is volume per atom in precipitation phase i, $x_1$ is atomic fraction of Cu in precipitation phase i, $V_{Al}$ is volume per atom Al, and $V_{Cu}$ is volume per atom Cu.

3. The method of claim 2, wherein the fraction of Cu in precipitate phase θ as a function of time and temperature may be expressed mathematically as:

$$f_\theta(t,T)=f_\theta^{eq}(T)(1-\exp[-k_\theta(T)(t+\Delta_\theta)^{n\theta}])$$

where $f_\theta^{eq}(T)$ is equilibrium phase fraction of precipitate phase θ, $k_\theta(T)$ is kinetic growth coefficient of precipitate phase θ, $\Delta_\theta$ is time shift applied to guarantee phase fraction continuity for precipitation phase θ, and $n_\theta$ is determined by at least precipitate morphology and nucleation rate for precipitation phase θ.

4. The method of claim 3, wherein the time shift applied to guarantee phase fraction continuity for precipitation phase θ may be expressed mathematically as:

$$\Delta_\theta = \frac{-1}{k_\theta(T_s)}\ln\left[1-\frac{f_\theta(t_a, T_a)}{f_\theta^{eq}(T_s)}\right]-t_a \text{ for } t \geq t_a$$

$$\Delta_\theta=0 \text{ for } t<t_a$$

where $T_t$ is in-service temperature, $T_a$ is aging temperature, and $t_a$ is time at which temperature changes from $T_n$ to $T_s$.

5. The method of claim 3, wherein the kinetic growth coefficient of precipitate phase θ may be expressed mathematically as:

$$k_\theta(T) = 0.43\exp\left[\frac{161}{473-T}-3.333\right]$$

where T is temperature in degrees Kelvin, and $k_\theta(T)$ is the kinetic growth coefficient of precipitate phase θ in units of inverse hours.

6. The method of claim 3, wherein the equilibrium phase fraction of precipitate phase θ may be expressed mathematically as:

$$f_\theta^{eq}(T) = 0.01417-\exp\left[-11.6045*\frac{370.9-0.097T}{T}\right]$$

where T is temperature in degrees Kelvin.

7. The method of claim 1, wherein the precipitation phases include at least the precipitate phase θ and the precipitate phase θ'.

8. The method of claim 7, wherein the fraction of Cu in precipitate phase θ' as a function of time and temperature may be expressed mathematically as:

$$f_{\theta'}(t,T)=f_{\theta'}^{eq}(T)(1-\exp[-k_{\theta'}(T)(t+\Delta_{\theta'})^{n\theta'}])-f_\theta(t,T)$$

where $f_{\theta'}^{eq}(T)$ is equilibrium phase fraction of precipitate phase θ', $k_{\theta'}(T)$ is kinetic growth coefficient of precipitate phase θ', $\Delta_{\theta'}$ is time shift applied to guarantee phase fraction continuity for precipitation phase θ', and $n_{\theta'}$ is determined by at least precipitate morphology and nucleation rate for precipitation phase θ', and $f_{\theta'}(t,T)$ is fraction of Cu in precipitate phase θ' as a function of time and temperature; wherein $f_{\theta'}(t,T)$ is greater than or equal to zero.

9. The method of claim 8, wherein the time shift applied to guarantee phase fraction continuity for precipitation phase θ' may be expressed mathematically as:

$$\Delta_{\theta'} = \frac{-1}{k_{\theta'}(T_s)}\ln\left[1-\frac{f_{\theta'}(t_a, T_a)}{f_{\theta'}^{eq}(T_s)}\right]-t_a$$

$$\Delta_{\theta'}=0 \text{ for } t<t_a$$

where $T_s$ is in-service temperature, $T_n$ is aging temperature, and $t_n$ is time at which temperature changes from $T_n$ to $T_s$.

10. The method of claim 8, wherein the kinetic growth coefficient of precipitate phase θ' may be expressed mathematically as:

$$k_{\theta'}(T) = 0.43\exp\left[\frac{-11800}{T}+24.34\right]$$

where T is temperature in degrees Kelvin, and $k_{\theta'}(T)$ is the kinetic growth coefficient of precipitate phase θ' in units of inverse hours.

11. The method of claim 8, wherein the equilibrium phase fraction of precipitate phase θ' may be expressed mathematically as:

$$f_{\theta'}^{eq}(T) = 0.01420-\exp\left[-11.6045*\frac{396.2-0.165T}{T}\right]$$

where T is temperature in degrees Kelvin.

12. The method of claim 1, wherein the predicting steps (a), (b), and (c) use a combination of first-principles calculations, computational thermodynamics, and electron microscopy and diffraction techniques.

13. A method for optimizing alloy heal treatment, the method comprising the steps of:

defining a thermal growth for dimensional stability;

predicting a combination of an aging time and an aging temperature which yields the thermal growth for dimensional stability; and aging a precipitation-hardened Al—Si—Cu alloy for about the predicted aging time and about the predicted aging temperature, wherein the predicting step uses a function of form:

$$g(t, T) = (1-\gamma)\sum_{i=1}^{n}\frac{\delta V_i}{3V_i}f_i(t, T)$$

wherein the function is inverted to solve for the predicted aging time and the predicted aging temperature based on a thermal growth of stability, and wherein aging for a combination of about the predicted aging time and about the predicted aging temperature produces a dimensionally stable precipitation-hardened Al—Si—Cu alloy.

* * * * *